US005166462A

United States Patent [19]

Suzuki et al.

[11] Patent Number: 5,166,462

[45] Date of Patent: Nov. 24, 1992

[54] MUSICAL TONE CONTROL APPARATUS EMPLOYING FINGER FLEXING ANGLE DETECTION

[75] Inventors: Hideo Suzuki; Masao Sakama, both of Hamamatsu, Japan

[73] Assignee: Yamaha Corporation, Hamamatsu, Japan

[21] Appl. No.: 493,290

[22] Filed: Mar. 14, 1990

[30] Foreign Application Priority Data

Mar. 17, 1989 [JP] Japan ..... 1-66620
May 18, 1989 [JP] Japan ..... 1-125428

[51] Int. Cl.[5] ..... G10H 1/34

[52] U.S. Cl. ..... 84/600; 84/621; 84/626; 84/644; 128/782

[58] Field of Search ..... 84/600, 621, 626, 644, 84/647, 662, 670, 671, 701, 718, 723, 735, 743, DIG. 7, DIG. 8; 2/160; 128/774, 782; 446/406, 408

[56] References Cited

U.S. PATENT DOCUMENTS 4,628,785 12/1986 Buchla ..... 84/DIG. 7 X
4,635,516 1/1987 Giannini .
4,905,560 3/1990 Suzuki et al. ..... 84/600
4,920,848 5/1990 Suzuki et al. ..... 84/600
4,962,688 10/1990 Suzuki et al. ..... 84/600
5,005,460 4/1991 Suzuki et al. ..... 84/600
5,046,394 9/1991 Suzuki et al. ..... 84/600

FOREIGN PATENT DOCUMENTS 63-210895 9/1988 Japan .

OTHER PUBLICATIONS

Published European Patent Application No. 264,782, Oct. 13, 1987, to Hiyoshi et al. "Musical Tone Control Apparatus Using a Detector".

*Primary Examiner*—William M. Shoop, Jr.
*Assistant Examiner*—Jeffrey W. Donels
*Attorney, Agent, or Firm*—Graham & James

[57] ABSTRACT

A musical tone control apparatus is provided with a compensation device which compensates a magnitude of detected signals output from each sensor arranged on each finger. Therefore, even though adjacent fingers are involuntarily bent when a specific finger is bent by the intention of a player, an interference which is given to the specific finger from the adjacent fingers is compensated by the compensation device, so that musical tone control signals can be generated from a control signal generation device in accordance with the bending of the specific finger without the interference caused by the adjacent fingers.

18 Claims, 8 Drawing Sheets

MUSICAL TONE CONTROL APPARATUS EMPLOYING FINGER FLEXING ANGLE DETECTION

BACKGROUND OF THE INVENTION

1. Field of the Invention

The present invention relates to a musical tone control apparatus capable of controlling musical tones such as a tone color, tone volume, effect, and the like, in accordance with motion of the fingers.

2. Prior Art

Conventional musical tone control apparatus is disclosed in Japanese Patent Application No. 63-210895. The specification of that application discloses two types of musical tone control apparatus for controlling generation of musical tones such as a tone color, tone volume, effect, and the like.

First musical tone control apparatus comprises switching devices for attaching to each finger so that each switching device becomes in an on-state in bending position of each finger, thereby generating musical tone control signals to indicate initiation of musical tone generation corresponding to the on-state of the switching device.

Second musical tone control apparatus comprises pressure sensing devices for attaching to each finger of the inside of a glove, so that the musical tone control signals are generated in correspondence with level of the signals output from each pressure sensing device in bending position of each finger.

However, in the first musical tone control apparatus, a player sometimes feels a sense of incongruity because each switching device is tripped in a fixed position. In addition, each tripping position of the switching devices is not adjusted to each bending position of the fingers even though one is readily bent, but the other is not. In other words, the bending angle for each finger is set at a common value. The fingers which readily bend, can readily turn the corresponding switching devices on, while those fingers which are less dexterous cannot readily activate the switching devices. Accordingly, it is difficult to operate the switching devices for the operator.

On the other hand, in the second musical tone control apparatus, there is also the same problem as the first musical tone control apparatus.

The details of the above problem are more described. In the case that musical tones are controlled by bending and stretching the fingers, an interference is caused between the fingers. That is, when the middle finger tends to bend, the index and third fingers are also involuntarily bent by the bending of the middle finger, so that a detected signal from the middle finger includes interference signals caused by the index and third fingers. Because of this, both signals of the index and third fingers are added to the signal of the middle finger, which makes a different signal than the player wanted to play in the musical tone control apparatus. In addition, the signal caused by the interference cannot be compensated because each of the switching devices and the pressure sensing devices has a fixed tripping position.

SUMMARY OF THE INVENTION

In consideration of the above described difficulties, it is an object of the present invention to provide a musical tone control apparatus capable of compensating interference signals caused by the adjacent fingers when a specific finger is bent and stretched by the intention of a player. Also the compensated signal makes suitable musical tones for the player.

In an aspect of the present invention, there is provided a musical tone control apparatus for controlling a musical tone control signal in correspondence with a magnitude of a bending angle for each finger, comprising: a plurality of bending angle detection devices for generating detected signals, each magnitude of which corresponds to the magnitude of the bending angle for each finger, each of the bending angle detection device is arranged on each finger; compensation device for compensating the magnitude of the detected signals with prescribed data; and control signal generation device for generating musical tone control signals based on the magnitude of compensated signals, the musical tone control signals are based on the magnitude of the bending angle depending on the intention of a player.

Accordingly, first feature of the invention is that the parameters for compensating interference caused by the adjacent fingers are previously provided for each finger. When a specific finger tends to bend, the adjacent fingers are also bent involuntarily. Each magnitude of the bending angle is then detected from each finger, while the intended bending magnitude, which means that the specific finger tends to bend, is obtained from a calculation between the parameter and the magnitude of detected angle corresponding to the adjacent fingers so that the interference caused by the adjacent fingers can be compensated to produce the musical tone control signals. In other words, the musical tone control signals can be precisely produced by the intention of the player.

Another feature of the invention is that the magnitude of the interference received from the adjacent fingers is subtracted from the physical bending magnitude or the magnitude of the detected angle, so that the intended bending magnitude can be readily obtained from the calculation.

Another feature of the invention is that a group of data which includes the magnitude of interference caused by the adjacent fingers is provided for each finger. Then, the magnitude of the detected angle for each finger is compared with the group of data. If the magnitude of the detected angle is equal to the group of data, the group of data represents a state of the bending or stretching of each finger, and this group of data is already compensated against the interference caused by the adjacent fingers, so that the state of the bending or stretching of each finger can be monitored precisely.

Another feature of the invention is that the bending characteristic data is previously provided for each finger. When the magnitude of the detected angle is read from each sensor, the magnitude of the detected angle is modified by the bending characteristic data, for example, since the third and little fingers are not readily bent with respect to the index and middle fingers, the musical tone control signals corresponding to the third and little fingers ar modified suitable for the player, so that the musical tone control signal can be generated in accordance with the intention of the player.

DETAILED DESCRIPTION OF THE PREFERRED EMBODIMENTS

Figure 1:
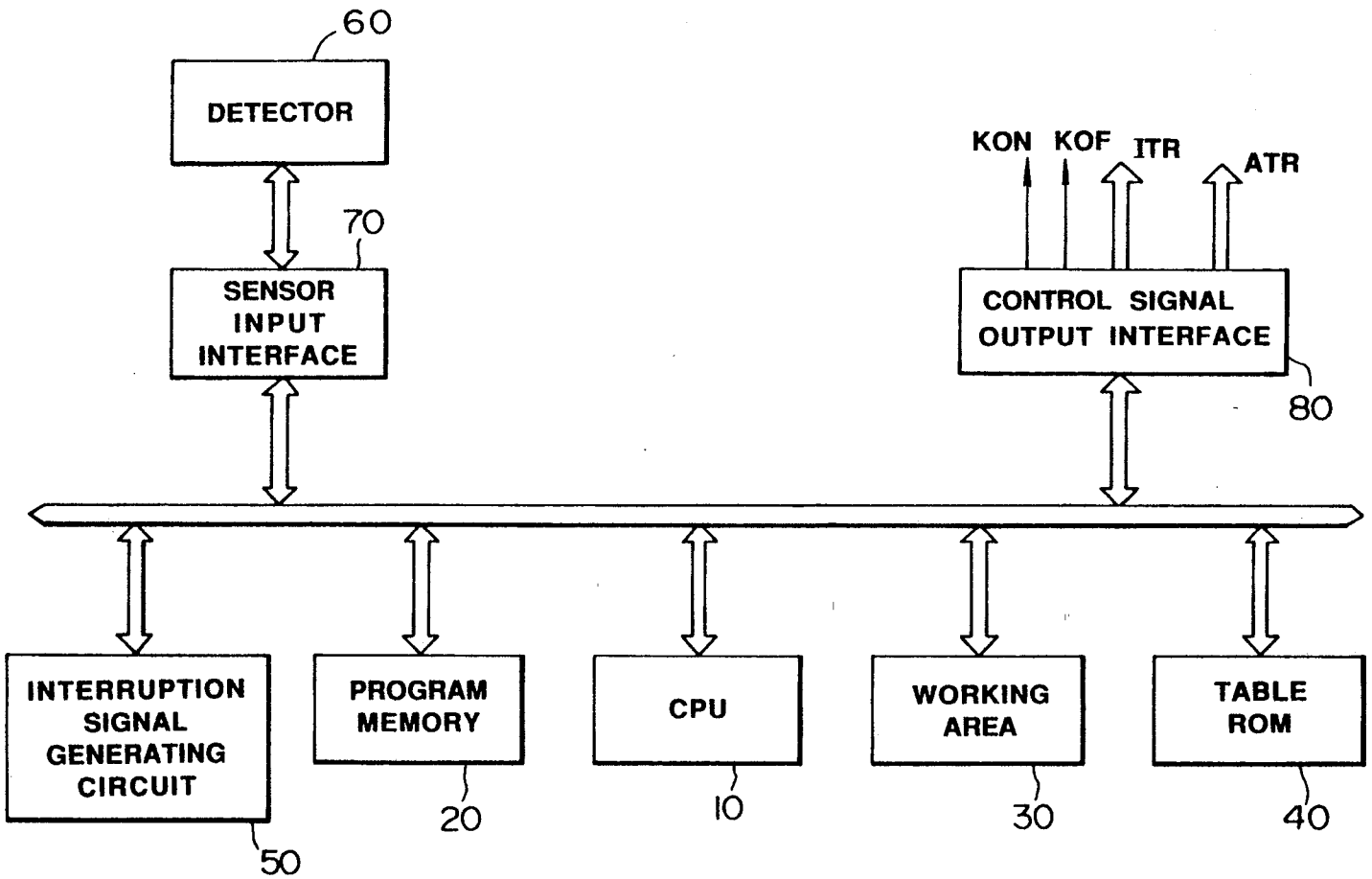
FIG. 1 is a block diagram showing a musical tone control apparatus of the first embodiment of the present invention.

Hereinafter, embodiments of the present invention are described with reference to drawings. FIG. 1 shows a construction of a musical tone control apparatus according to first embodiment of the present invention. In FIG. 1, CPU 10 is connected to a bus and carries out control programs stored in program memory 20. Some of the control programs carry out calculations for compensating interference caused by adjacent fingers when a signal is input from a specific finger, and also, carry out calculations of control signals for generating musical tones. The program memory 20 is also connected to the bus.

Working area 30 arranged in a RAM is also connected to the bus. It is a storage area which is used for temporarily storing data during the execution of control programs, so that CPU 10 can arbitrarily write data into working area 30, and can read out data from the area. Table ROM 40 stores data which is used for calculating the magnitude of the interference caused by the adjacent fingers; The data is readable from the table ROM 40 as instructed by CPU 10 through the bus.

Interruption signal generating circuit 50 is connected to the bus, and carries out an interruption process at every prescribed period of time during the execution of a main program. At this time, the interruption signal generating circuit 50 generates an interruption signal.

Detector 60 detects a magnitude of the angle when bending each finger, and generates a detection signal which is supplied to the bus through sensor input interface 70.

Control signal output interface 80 is connected to the bus, and outputs control signals generated from CPU 10 to an external tone generator which is not shown in the drawings.

Figure 2:
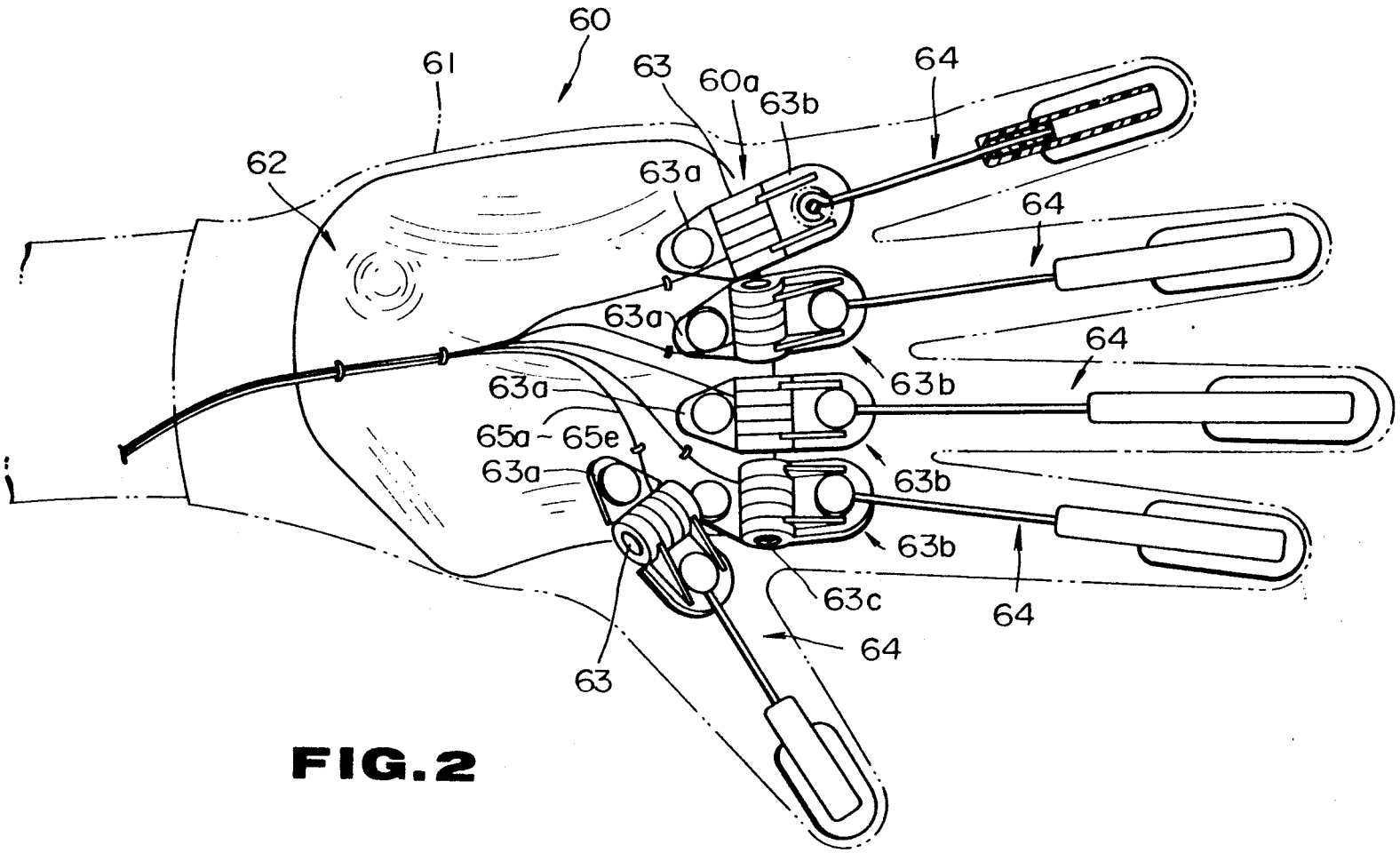
FIG. 2 is a detail view showing a detector.

FIG. 2 shows detector 60 having sensors 60*a* attached to a boundary area formed between each proximal portion of the fingers and the palm, respectively. Each of the sensors 60*a* detects the magnitude of the angle between each proximal portion of the fingers and the palm. Each magnitude of the angle is converted into an electronic signal which is supplied to sensor input interface 70. The converted electronic signal is an analog signal, which is converted into a digital signal.

The detailed construction of detector 60 is described. The detector 60 comprises a glove 61 having a double sheeted construction; a base portion 62 arranged on the palm between the double sheeted construction; sensors 60*a* fixed to base portion 62 which is positioned at the boundary area of the palm and each proximal portion of the fingers; and elongated portions 64 pivoted by each pivotal portion 63 of the sensors 60*a* and attached to each finger. In case of such construction, each of the sensors 60*a* has movable portions 63*a* and 63*b*, both of which are pivotally coupled by penetrating axis 63*c*. That is, both of the movable portions 63*a* and 63*b* are hingedly coupled. In addition, of rotatable variable resisters are formed between movable portions 63*a* and 63*b*, respectively, so that the magnitude of the angle between movable portions 63*a* and 63*b* can be detected by measuring the resistance of each rotatable variable resister through leads 65*a* to 65*e* when bending each finger.

CPU 10 carries out a signal process for the detected signals supplied from detector 60, and generates the following signals for controlling the musical tones; a key-on signal (referred to as KON signal below), a key-off signal (referred to as KOF signal below), an initial touch response signal (referred to as ITR signal below), and an after touch response signal (refer to as ATR signal below). Each of the KON, KOF, ITR, and ATR signals is output to the external tone generator through control signal output interface 80. CPU 10 carries out the signal process with the time divisional system when each of the detected signals is read from each sensor 60*a* through sensor input interface 70.

The external tone generator, which is not shown in the drawings, controls initiation and attenuation of the musical tone signal generation in accordance with the KON and KOF signals, and also, controls the musical tones such as a pitch, tone color, tone volume, and like in accordance with the ITR and ATR signals.

Figure 3:
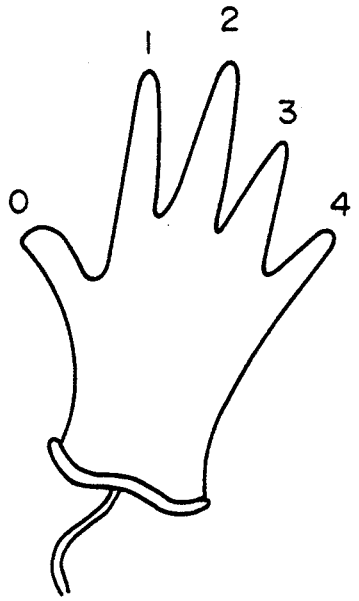
FIG. 3 is a front view showing the double-sheeted type of a glove.

The compensation of the interference is briefly described with reference to FIG. 3 and FIG. 4. In FIG. 3, each finger is named "0" to "4" in accordance with the order of the thumb to the little finger. When finger tends to bend with a magnitude of angle, there is a tendency for some of the remaining fingers to bend a prescribed angle in response to the bending of the finger. Each of the fingers has an individual prescribed angle when the adjacent fingers are bent.

The magnitude of the angle detected by each of the sensors 60*a* indicates a feature of the finger's movement, but this feature is not equivalent to a actual magnitude of the angle, which detected angle is not intended to bend by the operator. Therefore, a magnitude difference between the magnitude of the detected angle (referred to as a physical bending magnitude below) and the magnitude of the angle which is intended to bend by the operator (referred to as an intended bending magnitude below) is caused. This magnitude difference should be compensated by the present invention.

Since the intended bending magnitude is calculated from the physical bending magnitude to compensate for the interference, an interference ratio FPAR(I, J) is used. The interference ratio FPAR(I, J) is a value which defines an interference when a finger designated by "I" gives an interference to a finger designated by "J". Therefore, the interference ratio FPAR(I, J) is given by the following equation:

$$FPAR(I, J)=\{D2(J, I)-D1(J)\}/\{D2(I, I)-D1(I)\}$$

where D1(I) is a magnitude of the angle detected from the finger which is designated by "I" when the finger designated by "I" is not intended to bend by the operator, that is, this is an offset value which is detected by each sensor 60*a* corresponding to each finger, and D(I, J) is a magnitude of the angle detected from the finger which is designated by "I" when the finger designated by "J" is bent.

Thus, the interference ratio FPAR(I, J) is equal to a ratio which is divides a magnitude of the angle of a finger which receives an interference from an adjacent finger by a magnitude of the angle of the adjacent finger which gives the interference to the finger. The interference ratio FPAR(I, J) is stored in a memory, and also, if a parameter is indicated by "I" and "J", the interference ratio can be read from the memory. Each magnitude of the angles D(I) and D(I, J) is also stored in the memory as well as the interference ratio. The example of the interference ratio FPAR(I, J) is indicated in Table-1 as percentage (%) values.

TABLE-1

| | J | | | | |
|---|---|---|---|---|---|
| I | 0 | 1 | 2 | 3 | 4 |
| 0 | 00 | 01 | 01 | 01 | 00 |
| 1 | 05 | 00 | 32 | 12 | 05 |
| 2 | 00 | 45 | 00 | 40 | 12 |
| 3 | 00 | 20 | 38 | 00 | 46 |
| 4 | 02 | 15 | 21 | 39 | 00 |

Thus, the magnitude of the received interference in relation to the finger designated by "I" is obtained from the following calculation. That is, the magnitude of the received interference is obtained from multiplying the interference ratio which gives the interference to the finger designated by "I" by the magnitude of the angle corresponding to each finger. An equation is as follows:

$$\sum_{J=0}^{4} \{AD(J) - Dl(J)\} \times FPAR(J, I)$$

where AD(J) is a magnitude of the angle detected by each sensor 60*a* corresponding to each finger, and also, AD(J) is represented by AD(0) to AD(4). In the first portion of the equation enclosed by curly brackets,, the physical bending magnitude is is obtained by subtracting the offset value Dl(J) from the magnitude of the angle AD(J) which is detected by each sensor 60*a*. The physical bending magnitude is multiplied by the interference ratio FPAR(J, I), so that a magnitude of the interference is obtained from the equation.

Therefore, the intended bending magnitude is obtained by subtracting the magnitude of the interference obtained from the above equation from the magnitude of the angle detected by each sensor 60*a*. Accordingly, the interference can be compensated from the magnitude of the angle detected by each sensor 60*a*.

The following description describes how to obtain the musical tone control signals from the magnitude of the angle corresponding to each finger.

When a musical tone is controlled by bending and stretching each finger, the movement of the fingers should correspond to the musical tone control. That is, it defines that the musical tone generation starts at a prescribed angle when the bending of the angle exceeds the prescribed angle in the movement of the bend. Accordingly, the magnitude of the detected angle is compared with a prescribed reference magnitude. If the magnitude of the detected angle is greater than the reference magnitude, the KON signal is generated from the control signal output interface 80. In contrast, the musical tone generation is terminated at a prescribed angle when the bending of the angle exceeds the prescribed angle in the movement of the stretch. Accordingly, the magnitude of the detected angle is compared with the above reference magnitude. If the magnitude of the detected angle is smaller than the reference magnitude, the KOF signal is generated from the control signal output interface 80.

The ITR signal represents the speed of a finger's movement. In this embodiment, the speed is determined by a time period measured by a range from one magnitude of the angle which is detected from a finger to the other magnitude of the angle which is changed from the initial magnitude when bending the finger. In other words, it means that the time period is measured by a range when the finger bends from the prescribed position and reaches the other position. Accordingly, the speed of the finger's movement is obtained from the time period, and then, the ITR signal is generated. In addition, the ITR signal is generated at the time when the KON signal is output to the external tone generator because it is required for the starting of the musical tone generation.

The ATR signal represents the magnitude of the finger's movement, and it is generated during the generation of musical tones. That is, the ATR signal is only output to the external tone generator during the time range from the output of the KON signal to the output of the KOF signal.

In the case that such control signals are output, the result of the process carried out by CPU 10 is varied in accordance with the magnitude of the angle corresponding to the fingers.

Figure 4:
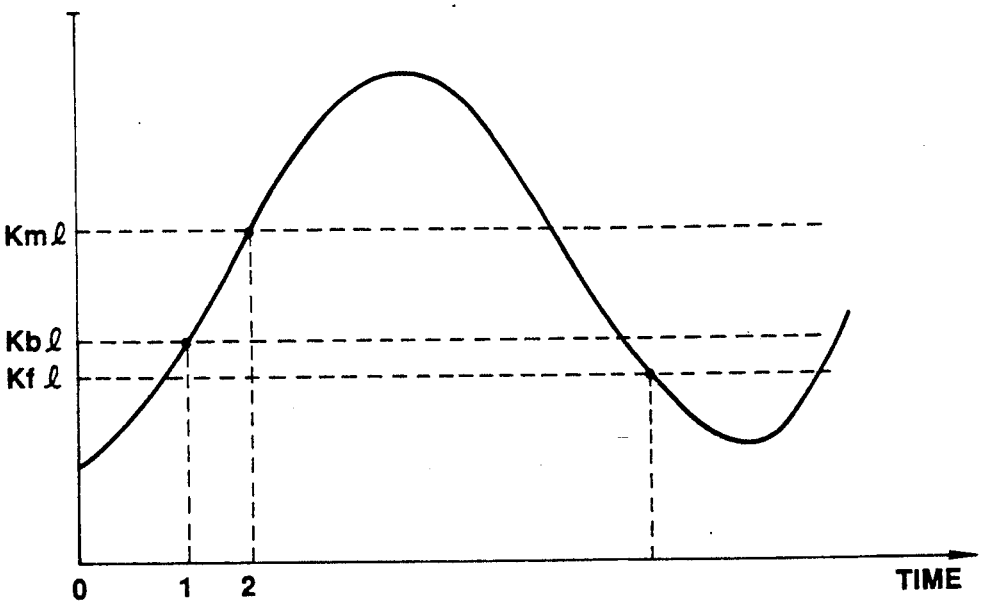
FIG. 4 is a graph showing the output signal of a sensor with respect to time.

FIG. 4 shows a relationship between the magnitude of the angle of the finger and elasped time. That is, it shows the feature of the bending finger which is gradually changed from the stretching to bending position. In a stage designated by "0", the magnitude of the angle is still smaller than first reference value Kbl when none of the musical tones are output. In a stage designated by "1", the magnitude of the angle exceeds the first reference value Kbl, and then, reaches a second reference value Kml which is greater than the first reference value Kbl. In a stage designated by "2", the magnitude of the angle exceeds the second reference value Kml, then falls to a third reference value Kfl which is smaller than the first reference value Kbl. After passing the stage designated by "2", the magnitude of the angle returns to the stage designated by "0".

The relation between the finger's bend and the control signals is described as follows:

When the magnitude of the angle corresponding to the finger gradually increases from the magnitude of nearly zero to a larger magnitude, it exceeds the first reference value Kbl, and a clock-counter begins to count clocks to generate the ITR signal. When the magnitude of the angle reaches the second reference value Kml, the clock-counter terminates counting the clocks, and then the KON signal is output to the external tone generator and the ITR signal is also output. At this time, the ATR signal also begins to output to the external tone generator. When the magnitude of the angle becomes less than the third reference value Kfl which is smaller than the first reference value Kbl, the KOF signal is output to the external tone generator, and then, the output of the ATR signal is terminated. Each of the first to third reference values Kbl, Kml, and Kfl is a relatively small value which indicates a beginning portion of each stage.

Figure 5:
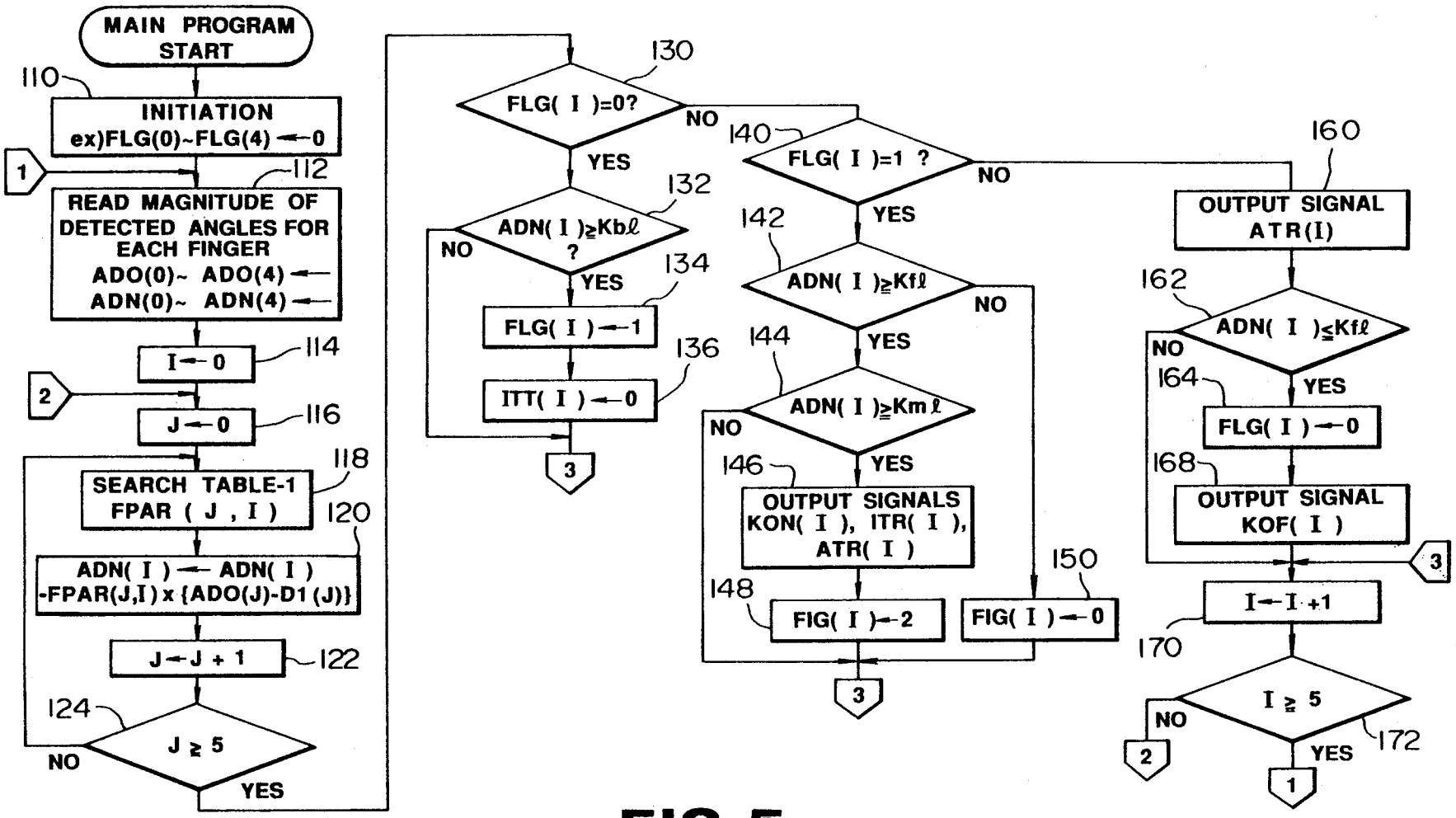
FIG. 5 is a flow chart showing the operation of the first embodiment of the present invention.
Figure 6:
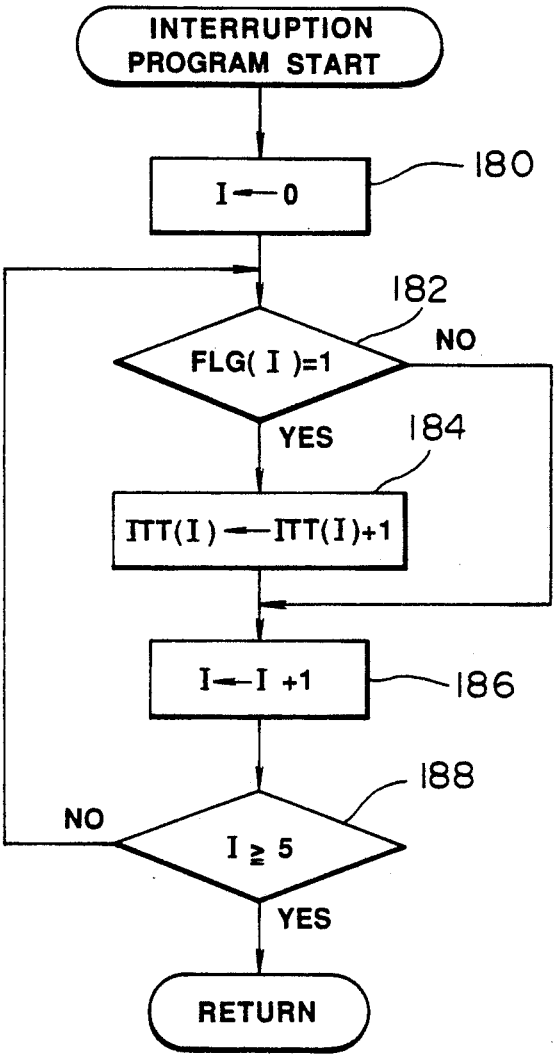
FIG. 6 is a flow chart showing an interruption program of the first embodiment.

The operation of the embodiment is described with reference to FIG. 5 and FIG. 6. FIG. 5 shows a main program, and FIG. 6 shows an interruption program which is carried out at every constant time to obtain time information during the execution of the main program.

In step 110, the main program carries out the initiation process for working area 30.

Since CPU 10 individually processes for each magnitude of the detected angle corresponding to each finger, flags FLG(0) to FLG(4) are assigned to the fingers, respectively. That is, the flag of "0" represents the stage designated by "0", the flag of "1" represents the stage designated by "1", and the flag of "2" represents the stage designated by "2", etc. In initial state, "0" is set in all flags FLG(0) to FLG(4) because none of the musical tones are generated.

In step 112, each magnitude of the detected angles corresponding to each finger is read from each sensor 60*a* through sensor input interface 70. Each magnitude of the angles including an interference is stored in the following storing areas: ADO(0) to ADO(4), and ADN(0) to ADN(4). The storing area ADN stores the intended bending magnitude. The magnitude of the interference is , in turn, subtracted from the value stored in ADN. Eventually, the intended bending magnitude is indicated by the value stored in ADN. The storing area ADO stores the magnitude of the detected angles including the interference.

In step 114, counter "I" is cleared by "0". In the process from step 114 to step 170, the counter "I" is incremented, and the process generates the intended bending magnitude corresponding to each finger, and then generates the control signals corresponding to the magnitude of the angles. This process, in turn, carries out from the finger designated by "0" to the finger designated by "4". If this process is carried out five times, the process returns to step 112 to read another magnitude of the detected angle, and repeats the process of five times.

If the value of the counter "I" is greater or equal to "5" in step 172, the process moves to step 116 to carry out a calculation by using counter "J". That is, the magnitude of the interference which is received from the finger designated by "J" is subtracted from the magnitude of the detected angle corresponding to the finger designated by "I".

That is, in step 116, the counter "J" is cleared by "0". In step 118, since the intended bending magnitude of the finger designated by "I" is obtained, the interference ratio FPAR(I, J) is read from the table ROM 40 to calculate the magnitude of the interference received from the finger designated by "J".

In step 120, the magnitude of the interference is obtained from a calculation which multiplies a value subtracted the offset value from the magnitude of the angle corresponding to the finger designated by "J", by the interference ratio FPAR(I, J). The magnitude of the interference obtained from the above calculation is subtracted from the the value stored in the storing area ADN(I) as the intended bending magnitude, and then, the value calculated by the subtraction is stored in the storing area ADN(I).

In step 122, the counter "J" is incremented by "1", then the process moves to step 124 to examine whether the process from step 118 to step 122 have been carried out by four times or not. That is, it is determined whether the value of the counter "J" is greater or equal to "5". When the process is terminated in step 124, the intended bending magnitude is stored in the storing area ADN(I), so that the intended bending magnitude no longer includes interference caused by the finger designated by "J".

By measuring the intended bending magnitude, the output of the musical tone control signal is carried out based on the magnitude of the detected angle. The following process depends on the state of the flags.

In step 130, the process examines whether the flag FLG(I) is equal to "0" or not. If the result is "YES", the process moves to step 132 to examine whether the magnitude of the angle exceeds the first reference value Kbl or not. That is, the it is determined whether process moves to the first stage or not, because the previous process for the finger designated by "I" is the zero stage. If the result is "YES" in step 132, the process moves to step 134. In the step 134, the flag FLG(I) is set to "1" for indicating the first stage moved from the zero stage. A counter ITT(I) is then cleared by "0" for preparing generation of the ITR signal in step 136.

The following description is for the counter ITT(I) to obtain the ITR signal.

The interruption program, as shown in FIG. 6, begins to carry out at every constant time during the execution of the main program. The counter "I" used in the interruption program is a variable different from the main program, and does not influence the counter "I" used in the main program.

In FIG. 6, request for an interruption makes the counter "I" clear by "0", to prepare for the next calculation in step 180. In step 182, the process examines whether the flag FLG(I) is equal to "1" or not. If the result is "YES", that is, it is the first stage, the counter ITT is incremented in step 186. In step 188, the process examines whether the value of the counter "I" is greater or equal to "5" or not. If the result is "NO", the process moves to step 182, that is, the counter ITT is incremented for each finger.

Since the interruption request is repeatedly carried out at every constant time, the counter ITT(I) is incremented in correspondence with the finger in the first stage. In addition, since the counter ITT(I) is cleared in step 136 when the first stage begins to process, the value of the counter ITT(I) is a elapsed time indicated from the beginning of the first stage.

In the main program, after clearing the counter ITT(I) by "0" in step 136, the process moves to step 170 to analyze the next finger. When the examination has decided that the first stage does not begin to process in step 132, the process also moves to step 170.

When the examination is decided that the flag FLG(I) is not equal to "0" in step 130, the process examines whether the FLG(I) is equal to "1" or not in step 140.

If the result is "1" in step 140, the process examines whether the magnitude of the angle ADN(I) is greater or equal to the third reference value Kfl or not in step 142. That is, whether or not the finger is stretched from the middle position thereof, even though an elapsed time has been initiated to measure for the ITR signal. The magnitude of the angle ADN(I) is not compared with the reference value Kbl because chattering tones and the like are neglected from the musical tone control signal by giving a hysteresis effect to the musical tone control signal. If the result is "NO" in step 142, that is, the magnitude of the angle ADN(I) is greater or equal to the reference value Kfl, the process moves to step 150 to set "0" to flag FLG(I), and then, moves to step 170.

Since the magnitude of the angle is normally increased, the result is "YES" in step 142. The process then moves to step 144. In step 144, the process examines whether the magnitude of the angle exceeds the second reference value Kml or not. If the result is "YES" in step 144, the second stage has been set, and the process decides that the finger is already bent at this time. Therefore, the KON and ITR signals are output to the control signal output interface 80, in which the ITR signal is equivalent to the value of the counter ITT(I). In addition, after outputting the KON signal, the magnitude of the angle ADN(I) is output to it as the ATR signal in step 146. Then, "2" is set in the flag FLG(I), that is, the second stage begins to process.

The KON, ITR, ATR, and KOF signals are composed of prescribed data output from CPU 10, that is, each of the KON and KOF signals is composed of On-Off data, the ITR signal is composed of the value of the counter ITT(I), and the ATR signal is composed of the magnitude of the angle ADN(I). These are transmitted from CPU 10 to buffers for each channel incorporated in the control signal output interface 80, then output to the external tone generator.

When the flag FLG(I) is set to "0" in step 150, that is, the process is returned to the zero stage, the process then moves to step 170 to analyze a next finger. When the second stage is not set up yet in step 144, and also, the flag FLG(I) is set to "2" in step 148, that is, the process is set up, the process moves to step 170.

When the flag FLG(I) is neither equal to "0" nor "1" in steps 130 and 140, the process should be the second stage, therefore, the ATR signal is output as the magnitude of the angle ADN(I) in step 160.

At this time, since the finger may be intended to stretch after bending, the third reference value Kfl is compared with the magnitude of the angle ADN(I) to examine whether tone generation is initiated or terminated in step 162.

If the magnitude of the angle ADN(I) is not less or equal to the third reference value, the process moves to step 170 to analyze a next finger. If the magnitude of the angle ADN(I) is less than the reference value Kfl, "0" is set to the flag FLG(I) in step 164. The KOF signal is then output from the control signal output interface 80 to the external tone generator.

Thus, the KOF signal gradually attenuates a musical tone output from the tone generator in correspondence with the channel.

CPU 10 repeatedly carries out the above process for each finger. Then, if the process decides that the process is terminated for all fingers in step 172, the process again moves to step 112 to read the magnitude of the detected angle for each finger.

In the embodiment, the interference between the fingers represents the ratio for obtaining a touch-signal from the intended bending magnitude of the fingers. In the case that the KON and KOF signals are generated by bending and stretching the fingers, the magnitude of the detected angle is nearly constant during the play, and the magnitude of the interference given by other fingers is also constant. Thus, the magnitude of the interference between the fingers can be stored in the table ROM 40 instead of the interference ratio. Accordingly, in the case where the magnitude of the interference is subtracted from the physical bending magnitude corresponding to each finger, the intended bending magnitude can be readily measured for each finger.

The following description is for a second embodiment of the present invention. In the embodiment, the output of the KON signal is only described for the sake of simplicity.

The number of combinations by bending and stretching five fingers represents the 5th. power of 2 (equal to 32). Thus, the magnitude of the angle corresponding to the thirty-second combinations can be stored in a memory. In addition, a group of the magnitude of the angle for each finger is composed of each combination. If the group of data is stored in the memory, such as pattern data, a magnitude of the detected angle can be read out from the memory as a combination of data.

Table-2 shows combination data composed of the magnitude of the detected angle of the the finger designated by "J" corresponding to the combination No. "I". The combination No. "I" represents a combination of binary numbers so that the number is ascended from the thumb to the little finger, "0" represents the bending and, "1" the stretching. In addition, the magnitude of the detected angle represents in the range from "0" to "200". The combination data shown in Table-2 can be written into a RAM when the musical tone control apparatus is shipped, or such data can be made individually in accordance with a player prior to his or her play, and into the RAM.

TABLE-2

| | | | | | | "J" | | | | |
|---|---|---|---|---|---|---|---|---|---|---|
| "I" | Tb | I | M | Td | L | 0 | 1 | 2 | 3 | 4 |
| 00 | 0 | 0 | 0 | 0 | 0 | 010 | 015 | 008 | 008 | 009 |
| 01 | 1 | 0 | 0 | 0 | 0 | 200 | 010 | 008 | 018 | 020 |
| 02 | 0 | 1 | 0 | 0 | 0 | 038 | 200 | 063 | 040 | 039 |
| 03 | 1 | 1 | 0 | 0 | 0 | 123 | 135 | 045 | 021 | 005 |
| 04 | 0 | 0 | 1 | 0 | 0 | 010 | 042 | 197 | 062 | 029 |
| . | . | . | . | . | . | . | . | . | . | . |
| . | . | . | . | . | . | . | . | . | . | . |
| . | . | . | . | . | . | . | . | . | . | . |
| 26 | 0 | 1 | 0 | 1 | 1 | 026 | 199 | 070 | 200 | 200 |
| 27 | 1 | 1 | 0 | 1 | 1 | 200 | 200 | 033 | 200 | 199 |
| 28 | 0 | 0 | 1 | 1 | 1 | 015 | 085 | 199 | 200 | 200 |
| 29 | 1 | 0 | 1 | 1 | 1 | 139 | 048 | 200 | 198 | 190 |
| 30 | 0 | 1 | 1 | 1 | 1 | 002 | 200 | 198 | 198 | 200 |
| 31 | 1 | 1 | 1 | 1 | 1 | 136 | 199 | 200 | 200 | 200 |

Notes: Tb;Thumb, I;Index finger, M;Middle finger, Td;Third finger, and L;Little finger.

In this embodiment, such combination data is stored in the RAM. On the other hand, each magnitude of the detected angles for each finger is composed of a group of data, such as, the group of data represented by a combination No. "I". Thus, a difference value is obtained from a difference between the group of data detected from each finger and the combination data stored in the RAM during the play. Actually, the magnitude of the detected angle for each finger should have the magnitude of interference, but if the combination data represents physical bending magnitude, the physical bending magnitude naturally includes the magnitude of the interference, so that a calculation for obtaining the magnitude of the interference is not required. The physical bending magnitude also includes offset values, so that a calculation is not necessary to subtract the offset value from the magnitude of the detected angle.

Figure 7:
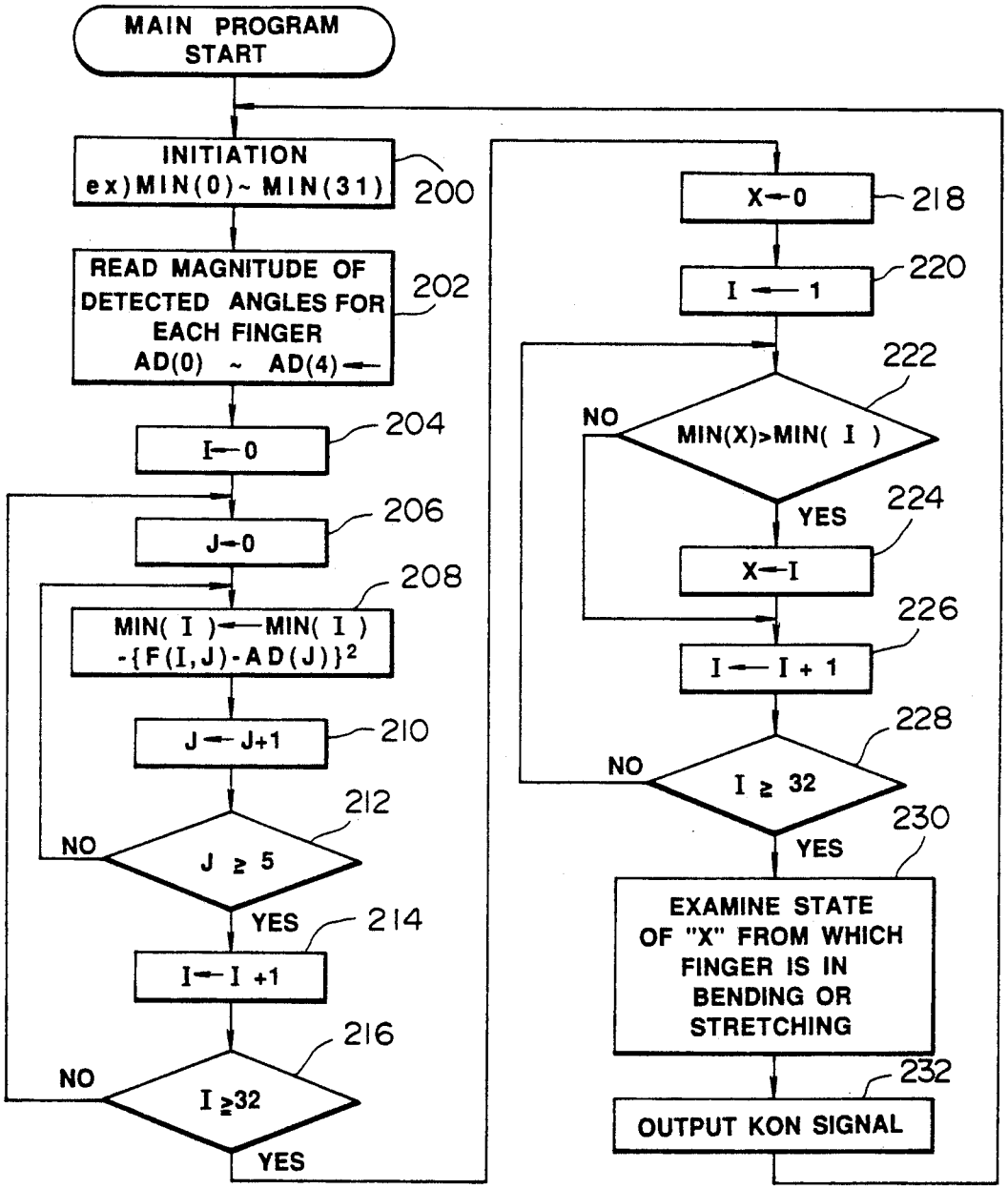
FIG. 7 is a flow chart showing the operation of the second embodiment of the present invention.

Accordingly, by calculating the difference value between the group of data detected from each finger and the combination data stored in the RAM, if both data is equal, the difference value should be "0" (actually, a small number of difference is produced between them). Thus, when the difference value is "0", that combination No. designated by "I" is the group of data which indicates the magnitude of the angle. Such process is described with reference to FIG. 7.

The construction of a musical tone control apparatus is similar to that of FIG. 1. The construction differs from FIG. 1 in that the control signal output interface 80 outputs the KON signal to the external tone generator. Combination data stored in the table ROM 40 is the magnitude of the detected angle F(I, J) for each finger.

Starting a main program carries out an initiation process for working area 30 in step 200. That is, storing areas MIN(0) to MIN(31) are cleared by "0" to store the difference values between the group of data and the magnitude of the detected data.

Each magnitude of the detected angles corresponding to the fingers is written into the storing areas AD(0) to AD(4) in step 202, respectively.

The difference value is calculated along each combination of the five fingers to compose of a group of data, thereby composing of whole combination data. Each of the difference values is obtained from a calculation which subtracts the magnitude of the detected angle from the combination data corresponding to the fingers as shown in Table-2, and then, the difference value is made a square. Because of this, a counter "I" is cleared by "0" in step 204.

In steps 206 to 212, each of the difference values is calculated for each group of data. That is, in step 206, a counter "J" is cleared by "0" to calculate difference values for each finger, and then, in step 208, the difference value is calculated from changing the counter "J" from "0" to "4" in steps 210 and 212.

The counter "I" is then incremented in step 214. In step 216, the process examines whether all groups of data are completed or not. If the result is "YES", the process moves to step 218, otherwise it moves to step 206 to calculate the rest of the difference values.

When the calculation of the difference values is completed, then a combination No. which indicates a minimum value designated by MIN(x) is searched from the storing areas MIN(0) to MIN(31). This process is as follows:

In step 218, a variable "x" which indicates the combination No. is set to "0". The counter "I" is then set to "1" in step 220. The process compares the difference value of the group of data which should be the minimum value with the difference value of the group of data which is indicated by the counter "I" in step 222. If the difference value indicated by the counter "I" is smaller than the difference value which should be the minimum value, the value which indicates a combination No. is stored in the variable "x" in step 224. Conversely, if the difference value indicated by the counter "I" is greater than the difference value which should be the minimum value, the counter "I" is incremented in step 226. In step 228, if a search process is terminated up to the thirty-second of the combination No., the variable "x" indicates the combination No., the difference value of which is the minimum value. The minimum value corresponds to the group of data which is one of the lateral group of data shown in Table-2. In step 230, if the minimum value is represented by the binary numbers, the state of the fingers can be seen whether each of the fingers is in bending or stretching from the thumb to the little finger. For example, referring to Table-2, if the variable "x" is equal to 6 (x TM 6), that is, the combination No. is "6", 6 is represented "0 1 1 0 0" by the binary-coded-decimal number, which is not indicated in Table-2, but it is obvious. Thus, the index and middle fingers are bending.

At this time, CPU 10 transmits prescribed data to the control signal output interface 80 to output the KON signals corresponding to the index and middle fingers to the external tone generator in step 232. Accordingly, the KON signals are output to the external tone generator during the bending of the fingers.

As a result, the external tone generator begins to generate musical tone signals at the rising time of the KON signal, and the musical tone signals are generated from the external tone generator until a prescribed time is elapsed after the falling of the KON signal.

In the embodiment, since sensors 60*a* are arranged on each finger, the musical tone control apparatus detects the magnitude of the angle corresponding to the fingers, and converts the magnitude of the detected angle into the prescribed data to transmit to each channel of the control signal output interface 80. Accordingly, for example, do, re, mi, and the like of tone pitch having the same tone color can be assigned to each channel, or each tone of the musical instruments such as a cymbals, a bass drum, and the like can also be assigned to each channel.

After outputting the KON signal to the external tone generator, the process again moves to step 200 to repeat the execution of the main program.

In the embodiment, the output of the KON signal is only described and touch-signal is not output from the control signal output interface 80. However, in the case that the touch-signals of number of "N" stages are produced, or controls of number of "N" types are carried out, the number of $N^5$ of the combination data are provided, and the number of $N^5$ are also provided to store the physical bending magnitude as the combination data.

Figure 8:
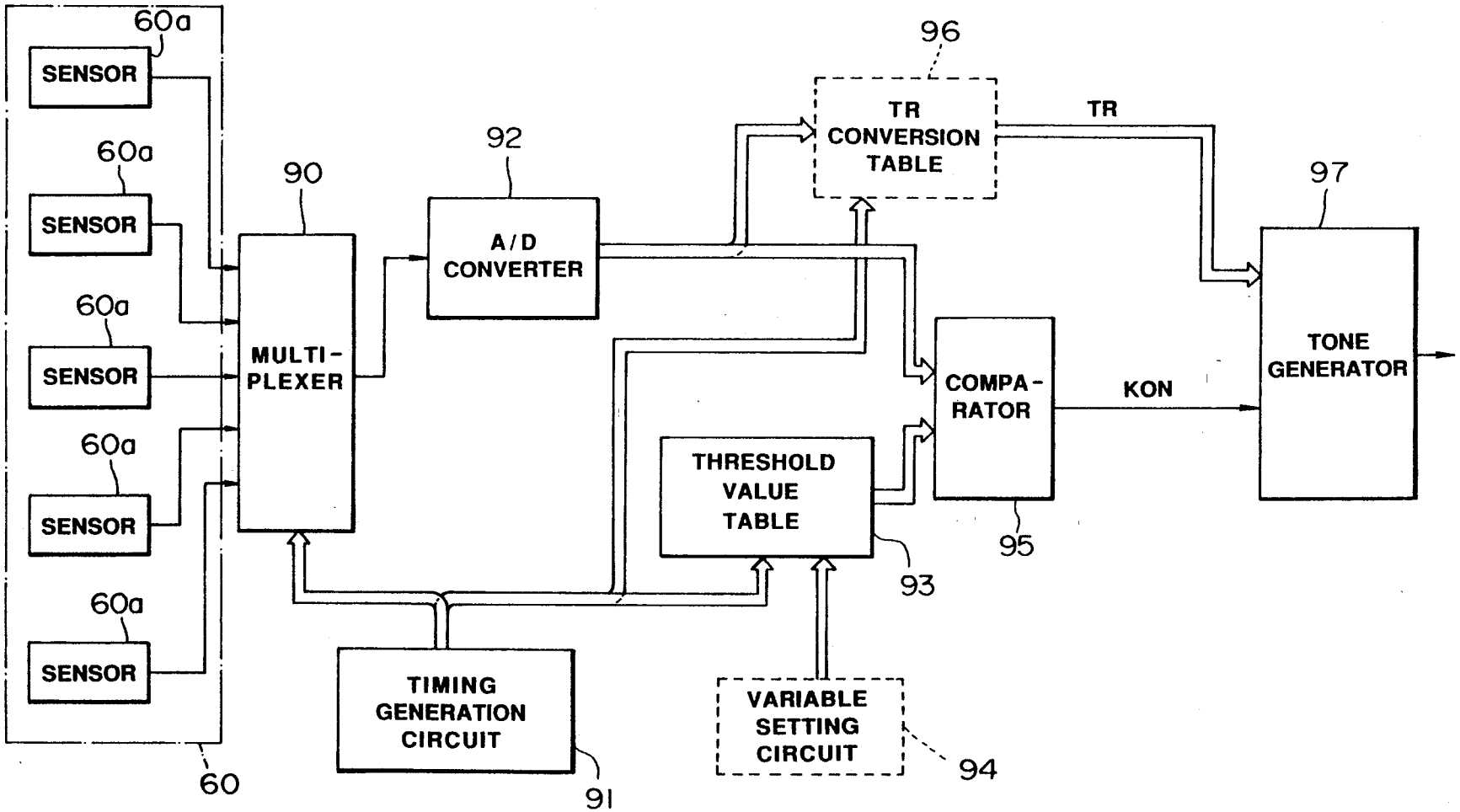
FIG. 8 is a block diagram showing another musical tone control apparatus of the third embodiment of the present invention.

The following description is for a third embodiment of the present invention. FIG. 8 shows another type of a musical tone control apparatus. Each of the sensors 60*a* is arranged on each finger as shown in FIG. 2, and connected to multiplexer 90 to supply a detected signal indicated by a magnitude of the detected angle thereto. Multiplexer 90 receives timing pulse supplied from timing generation circuit 91, in which the timing pulse corresponds to a time division for each finger. In multiplexer 90, the magnitude of the detected angle received from each of the sensors 60*a* is multiplexed with each timing pulse, thereby the so-called time division multiplex system is carried out. Each of the analog signals from each sensor 60*a* is supplied to A-D converter 92 by the time division. A-D converter 92, in turn, converts the analog signals into digital signals. That is, the magnitude of the detected angle from each sensor is converted from an analog signal into a digital signal.

Threshold value table 93 stores threshold values for generating threshold value signals corresponding to each analog signal received from each sensor 60*a* . Threshold value table 93 also receives the timing pulse from timing generation circuit 91 so that the threshold value signal is synchronized with the analog signal based on the timing pulse, because the analog signal received from each sensor 60*a* is multiplexed with the timing pulse. Accordingly, in threshold value table 93, a threshold value signal is read out from threshold value table 93 at ever timing of each timing pulse when an analog signal from a sensor 60*a* matches with a threshold value stored in threshold value table 93. In addition, threshold value table 93 is connected to variable setting circuit 94 which changes the threshold value stored in it so that the threshold value signal can be adjusted t the performance of the player.

Both the digital signal output from A-D converter 92 and the threshold value signal output from threshold value table 93 are output to comparator 95. The comparator 95 compares the digital signal with the threshold value signal. If magnitude of the digital signal is greater than that of the threshold value signal, comparator 95 outputs the KON signal to tone generator 97.

Furthermore, the digital signal output from A-D converter 92 is also output to touch-response conversion table 96 (referred to as TR conversion table below) in accordance with the timing pulse which has been supplied to multiplexer 90 and threshold value table 93 as well. TR conversion table 96 stores touch-response data for modifying the magnitude of the angle or digital signal corresponding to the fingers so that the digital signal becomes a prescribed value, and generates a touch-response signal (referred to as TR signal below) corresponding to the digital signal for each finger. That is, a digital signal from A-D converter 92 searches the touch-response data, and if the digital signal matches with the touch-response data, TR conversion table 96 generates a TR signal corresponding to the touch-response data, and outputs the TR signal to tone generator 97. Therefore, the TR signal is being modified by the digital signal corresponding to each finger. When the digital signal searches corresponding touch-response data and the TR signal is output from TR conversion table 96, this operation is carried out by the timing pulse as well as the operations of multiplexer 90 and threshold value table 93.

When tone generator 97 receives the TR signal and KON signal from TR conversion table 96 and comparator 95, respectively, tone generator 97 generates musical tone signals corresponding to both TR and KON signals.

The following description explains how to determine the threshold value.

The musical tone control apparatus detects the magnitude of the angle for each finger through each sensor 60*a*, however, each finger is not precisely bent. For example, the thumb and index fingers are readily bent by the intention of the player, but the third and little fingers are not. That is, the bending characteristic for each finger is different.

Accordingly, the threshold value stored in threshold value table 93 is varied in response to the bending characteristic for each finger. In this case, the threshold value stored in threshold value table 93 can be determined by the bending characteristic for each finger, which is obtained from statistical measurement, and also, it can be determined by an individual bending characteristic for each player. In addition, the threshold value can be set to a small value for the third and little fingers in case the third and little fingers cannot be readily bent. If the third and little fingers are involuntarily bent by the adjacent finger, for example, when the middle finger is bent, the threshold values for the third and little fingers can be set to a relatively large value. On the other hand, variable setting circuit 94 can write threshold values for each finger into threshold value table 93, and also, can totally change the threshold values in threshold value table 93.

The bending characteristic influences the TR signal corresponding to the magnitude of the bending angle. Because of this, in TR conversion table 96, the touch-response data is modified in correspondence with the analog signal output from each sensor 60*a*, and the modified TR signal regarding the bending characteristic is output from TR conversion table 96.

For example, assuming that the index and little fingers are fully bent, at this time, the magnitude of the analog signal output from the sensor 60*a* for the index finger may not be equal to that of the analog signal from the little finger. In this case, both the analog signals from the index and little fingers are modified so that these signals should be the same magnitude.

Accordingly, the KON signal and TR signal are suitable for the intention of the player, and tone generator 97 can generate musical tone signals in accordance with the KON and TR signals.

Since tone generator 97 has 5-channels, tone pitches with the same tone color, such as do, re, mi . . . can be assigned to the channels, respectively, and musical tones, such as cymbals, bass drum, and the like can also be assigned to the channels.

The TR signal can be output to tone generator 97 with the same timing as the KON signal, so that a tone color, tone volume, effect, and the like can be readily controlled.

The following description is for a fourth embodiment of the present invention.

Figure 9:
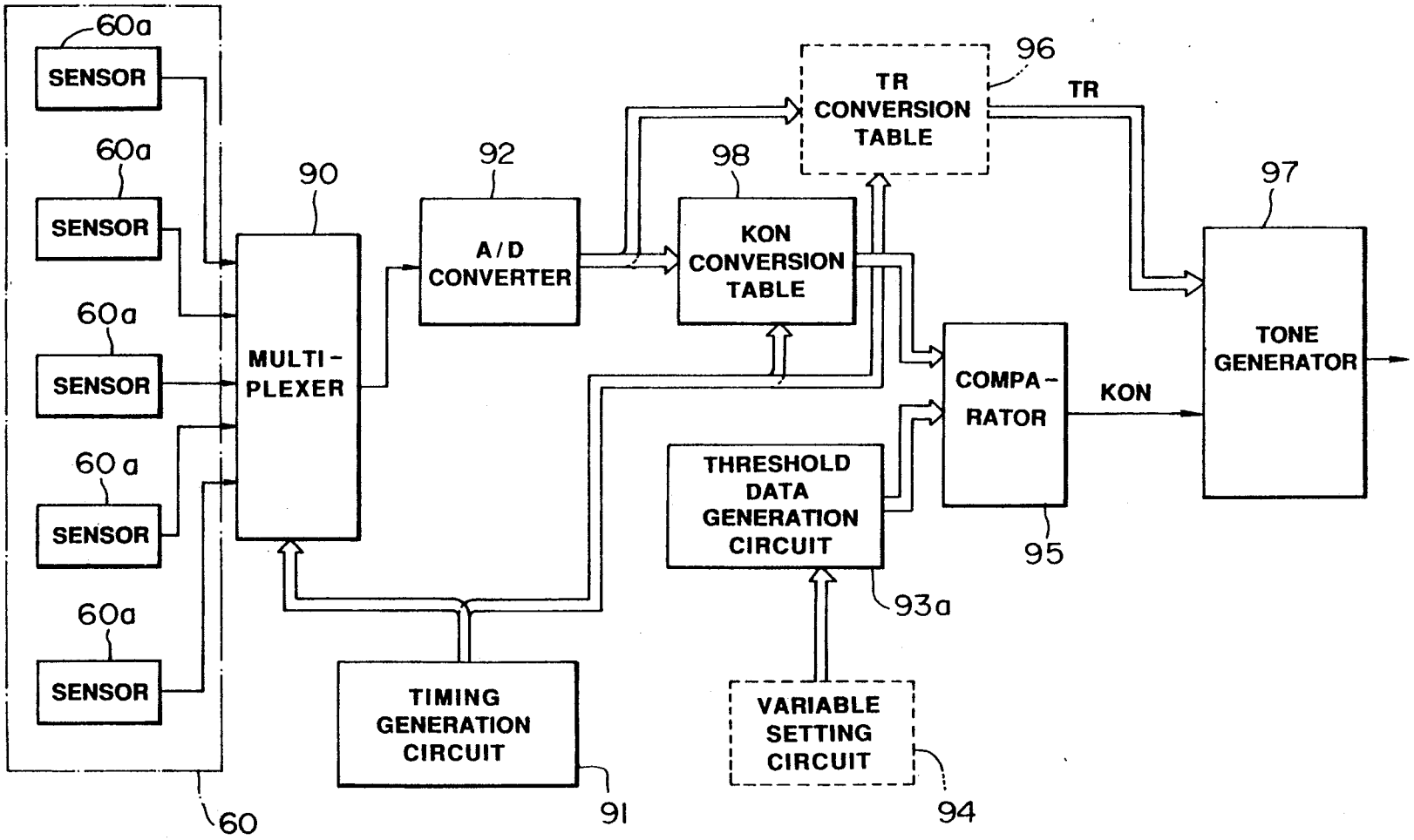
FIG. 9 is a block diagram showing another musical tone control apparatus of the fourth embodiment of the present invention.

FIG. 9 shows another musical tone control apparatus having a threshold data generation circuit 93*a* instead of the threshold value table 93 shown in FIG. 8, and additionally having a key-on conversion table 98 (referred to as the KON conversion table below). The rest of the construction is the similar to the third embodiment shown in FIG. 8, therefore the same reference numbers are designated in FIG. 9, and the detailed description is omitted for the sake of simplicity.

In FIG. 9, the timing pulse is not supplied to threshold value data generation circuit 93*a*. Threshold value data generation circuit 93*a* generates prescribed threshold values changeable by variable setting circuit 94, and outputs them to comparator 95. KON conversion table 98 is connected between A-D converter 92 and comparator 95, and modifies the digital signal output from each sensor 60*a* via A-D converter 92 in accordance with the bending characteristic of each finger. KON conversion table 98 therefore stores bending characteristic data.

According to the above construction, the operation of the multiplexer 90 and A-D converter 92 is similar to the third embodiment. In this case threshold value data generation circuit 93*a* outputs the prescribed threshold values to comparator 95 without being synchronizing by the timing pulse. Because of this, when it is determined whether a finger is bent or not in correspondence with the bending characteristic for each finger, the bending characteristic is considered to modify the digital signal output from A-D converter 92 in KON conversion table 98. For example, the digital signal corresponding to the finger which is readily bent is modified to a relatively small bending characteristic signal, and modified to a relatively large bending characteristic signal for the finger which is not readily bent. Accordingly, such modification is synchronized with the timing pulse which is supplied to A-D converter 92 through multiplexer 90.

Comparator 95 receives the bending characteristic signal from KON conversion table 98 and the prescribed threshold value signal from threshold data generation circuit 93a. Comparator 95 then compares the bending characteristic signal with the prescribed threshold value signal, that is, it is determined whether a finger is bent or not. If the magnitude of the bending characteristic signal is greater than the magnitude of the prescribed threshold value signal, the KON signal is output from comparator 95 to tone generator 97.

In this embodiment, each sensor 60a which generates an analog signal can be replaced with another type of a sensor which generates digital signals. In the case of using such a sensor, A-D converter 92 can be removed from the musical tone control apparatus. The rotatable type of variable resister is incorporated in each sensor 60a, but another type of variable resistor can be used in the sensor 60a instead of the rotatable type.

The KON signal is generated from comparator 95 based on the prescribed threshold value output from threshold value data generation circuit 93a, but it can be generated from a characteristic based on the hysteresis of the KON signal, that is, based on a reference value when the KON signal changes from Off-state to On-state. Accordingly, if the reference value is set to a relatively small value in changing from Off-state to On-state, the examination can be accurately carried out whether a finger is bent or not.

In the third and fourth embodiments, the analog signal output from each sensor 60a is multiplexed with the timing pulse, in other words, the serial transmission process is carried out, but the parallel transmission process can be done. Variable setting circuit 94 and TR conversion table 96 can be removed from the musical tone control apparatus. Finally, A-D converter 92 is provided for high-speed process in the musical tone control apparatus, but if it is not required to carry out the high-speed process, the timing pulse can be supplied to A-D converter 92 for converting the analog signal into the digital signal.

The preferred embodiments described herein are illustrative and not restrictive. The scope of the invention is indicated by the appended claims and all variations which fall within the claims are intended to be embraced therein.

What is claimed is:

1. A musical tone control apparatus for controlling a musical tone control signal in correspondence with a magnitude of a bending angle for each finger, comprising:

a plurality of bending angle detection means for generating detected signals, each magnitude of which corresponds to the magnitude of the bending angle for each finger, each of the bending angle detection means being adapted to be arranged on a finger;

compensation means for modifying the magnitude of the detected signals, wherein said compensation means stores parameters including parameters related to interference in the detection of bending of a specific finger caused by adjacent fingers which are involuntarily bent when bending the specific finger; and control signal generation means for generating musical tone control signals based on the magnitude of compensated signals, wherein the musical tone control signals are based on the magnitude of the physical bending angle.

2. A musical tone control apparatus according to detection means generates each of said detected signals corresponds to a physical bending magnitude of each respective finger, and wherein each of the bending angle detection means is arranged on each respective finger.

3. A musical tone control apparatus according to claim 1 wherein the control signal generation mans generates musical tone control signals produced by an intended bending magnitude calculated from the physical bending magnitude for each finger and one of the parameters.

4. A musical tone control apparatus according to claim 2 wherein said compensation means stores ratios of interferences which are caused between adjacent fingers and a specific finger for each finger, wherein the ratio of interference is used to compensate for the interference.

5. A musical tone control apparatus according to claim 4 in which the control signal generation means generates a musical tone control signal produced by an intended bending magnitude obtained from first deriving an interference magnitude which is allocated to the adjacent fingers and which is calculated based one each ratio of interference, and secondly subtracting the interference magnitude from the physical bending magnitude of the specific finger.

6. A musical tone control apparatus according to claim 2 in which the compensation means stores combination data composed of a number of group data, wherein each of the group data is composed of a combination of the physical bending magnitude corresponding to the fingers which indicate a state of the bending or stretching.

7. A musical tone control apparatus according to claim 6 wherein the control signal generation means for generating a musical tone control signal produced by an intended bending magnitude is determined by a minimum combination difference, the minimum difference being obtained by comparing a combination of the physical bending magnitude for each finger with each group of data in the combination data.

8. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on said finger, so as to correct for spurious interference signals generated by the action of involuntary flexing of adjoining fingers on said detection means disposed on adjoining fingers; and control signal generation means for generating musical tone control signals based on the magnitude of modified tone control signals, whereby said modified control signals provide an accurate reproduction of an intended musical effect created by a performer.

9. The musical tone control apparatus according to claim 8, wherein the control signal generation means generates musical tone control signals calculated from said physical angle of the flexing finger with the use of parameters stored in said compensation means to reproduce the intended musical effect of the performer.

10. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals generated by involuntary flexing of adjoining fingers, wherein said compensation means further includes memory means for storing calculated ratios of interference, including a standard value for each finger and an inter-relationship between adjoining fingers, for use in modifying the detected signal; and control signal generation means for generating musical tone control signals based on the magnitude of modified tone control signals, whereby said modified control signals provide an accurate reproduction of an intended musical effect created by a performer.

11. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals being generated by involuntary flexing of adjoining fingers; and control signal generation means for generating musical tone control signals based on the magnitude of modified tone control signals, wherein a value of said flexed angle is calculated by subtracting an interference magnitude, calculated based on stored interference ratios, from the physical bending magnitude of said finger, whereby said control signals provide an accurate reproduction of an intended musical effect created by said finger of a performer.

12. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals generated by involuntary flexing of adjoining fingers, wherein said compensation means stores combination data composed of a group of numbers data, wherein said data is composed of a combination of the physical bending magnitude corresponding to a finger which indicates a state of flexing or stretching; and control signal generation means for generating musical tone control signals based on the magnitude of modified tone control signals, whereby said modified control signals provide an accurate reproduction of an intended musical effect created by a performer.

13. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals generated by involuntary flexing of adjoining fingers, wherein the compensation means comprises modifying means which modifies each detected signal independently in accordance with a flexing characteristic of each finger, and generates reference signals corresponding to each finger; and control signal generation means for generating musical tone control signals based on the magnitude of modified tone control signals, whereby aid modified control signals provide an accurate reproduction of an intended musical effect created by a performer.

14. A musical tone control apparatus according to claim 13 in which the control signal generation means generates musical tone control signals according to a comparison between the modified detection signal and the reference signal.

15. A musical tone control apparatus for controlling a musical tone control signal in correspondence with a flexing angle of a flexing finger, said apparatus comprising:

detection means for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals being generated by involuntary flexing of adjoining fingers; and control signal generation means for generating musical tone control signals based on the magnitude of the modified detection signals, said generation means further comprising touch detection means for detecting an initial touch based on the magnitude of the modified detection signals and for modifying the musical tone control signals in accordance with the initial touch, whereby said modified tone control signals provide an accurate reproduction of an intended musical effect created by a performer.

16. A musical tone control apparatus for controlling a musical tone control signal in correspondence with a flexing angle of a flexing finger, said apparatus comprising:

a flexing angle detection means arranged on each finger for detecting the magnitude of flexing for each finger and generating signals in correspondence with the magnitude of the flexed angle for each finger, wherein said magnitude of flexing is related to a physical angle of said flexing finger;

compensation means for modifying the detected signals produced by said detection means on each finger, so as to correct for spurious signals produced by said detection means, said spurious signals generated by involuntary flexing of adjoining fingers, wherein said compensation means recognizes a state of the flexed angle for each of the fingers, detected by the flexing angle detection means, as a flexing pattern of the fingers, and the control signal generation means generates the musical tone control signals based on the flexing pattern; and control signal generation means for generating musical tone control signals based on the magnitude of modified tone control signals, whereby said modified control signal provides an accurate reproduction of an intended musical effect created by a performer.

17. The musical control apparatus according to claim 5 in which the interference magnitude is calculated by multiplying the physical bending magnitude by each ratio of the interferences.

18. The musical control apparatus according to claim 16 in which said state of the flexed angle for each of the fingers from the thumb to the little finger represents whether a finger is in a flexing or stretching state.

* * * * *